US008198791B2

(12) United States Patent
Suzuki

(10) Patent No.: US 8,198,791 B2
(45) Date of Patent: Jun. 12, 2012

(54) SPARK PLUG, AND METHOD FOR MANUFACTURING THE SAME

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 74 days.

(21) Appl. No.: 12/936,188

(22) PCT Filed: Mar. 26, 2009

(86) PCT No.: PCT/JP2009/056064

§ 371 (c)(1),
(2), (4) Date: Oct. 1, 2010

(87) PCT Pub. No.: WO2009/122996

PCT Pub. Date: Oct. 8, 2009

(65) Prior Publication Data

US 2011/0043094 A1 Feb. 24, 2011

(30) Foreign Application Priority Data

Apr. 2, 2008 (JP) ..... 2008-096278

(51) Int. Cl.
*H01T 13/00* (2006.01)
*H01T 21/02* (2006.01)

(52) U.S. Cl. ..... 313/144; 313/118; 445/7

(58) Field of Classification Search ..... None
See application file for complete search history.

(56) References Cited

U.S. PATENT DOCUMENTS

| | | | |
|---|---|---|---|
| 6,111,345 | A | 8/2000 | Shibata et al. |
| 2003/0168954 | A1 | 9/2003 | Suzuki et al. |

FOREIGN PATENT DOCUMENTS

| | | | |
|---|---|---|---|
| JP | 11-111424 | A | 4/1999 |
| JP | 2003-257582 | A | 9/2003 |
| JP | 2006-92955 | A | 4/2006 |

*Primary Examiner* — Toan Ton
*Assistant Examiner* — Britt D Hanley
(74) *Attorney, Agent, or Firm* — Sughrue Mion, PLLC

(57) ABSTRACT

A spark plug and method of manufacturing the same. The spark plug includes a tubular insulator holding a center electrode, and a tubular metallic shell holding the insulator. The insulator is inserted into the metallic shell from the rear end side thereof until a portion of the insulator engages the metallic shell. In this state, the circumferential edge of the rear end portion of the metallic shell is crimped, whereby the insulator is unitarily fixed to the metallic shell. A talc charged layer is formed in a clearance portion between the insulator and the metallic shell, and a wire packing is placed on a rear end portion of the talc charged layer for engaging the crimp portion. A portion of the talc charged layer is interposed between the wire packing and the rear trunk portion of the insulator.

11 Claims, 12 Drawing Sheets

SPARK PLUG, AND METHOD FOR MANUFACTURING THE SAME

TECHNICAL FIELD

The present invention relates to a spark plug used for ignition in an internal combustion engine. More particularly, the present invention relates to a spark plug in which a metallic shell and an insulator are unitarily fixed by means of crimping the metallic shell, and to a method for manufacturing the same.

BACKGROUND ART

In general, a spark plug used for ignition in an internal combustion engine, such as an automotive engine, includes a center electrode, an insulator that holds the center electrode, and a tubular metallic shell provided outward of the insulator, wherein a ground electrode welded to a front end portion of the metallic shell and a front end portion of the center electrode face each other to thereby form a spark discharge gap therebetween. In use, such a spark plug is attached to the internal combustion engine so that its front end (the spark discharge gap) is located within a combustion chamber.

The above-mentioned insulator is inserted into the metallic shell from its rear end side toward the front end side thereof until a stepped portion formed on the outer circumference of the insulator and facing toward the front end thereof comes into engagement with a stepped portion formed on the inner circumference of the metallic shell and facing toward the rear end thereof. In this state, the circumferential edge of a rear end portion of the metallic shell is crimped radially inward so as to form a crimp portion, whereby the insulator is unitarily fixed to the metallic shell.

When a gas mixture is combusted within the combustion chamber, the pressure of combustion gas of high temperature and high pressure acts on the spark plug. Therefore, in general, on the front end side of the metallic shell, a packing or the like is disposed in a clearance between the insulator and the metallic shell, and a crimping load sufficient for preventing leakage of the combustion gas is applied thereto, whereby the gastightness of the spark plug is enhanced. Meanwhile, in some cases, on the rear end side of the metallic shell where the crimp portion is formed, seal material powder, such as talc powder, is charged into a clearance between the inner circumferential surface of the metallic shell and the outer circumferential surface of the insulator, and a packing formed of metal is interposed therebetween. In such a case, the circumferential edge of the rear end portion of the metallic shell is crimped so as to push the packing placed on a layer of the seal material powder toward the front end side with respect to the axial direction and toward the radially inner side, to thereby compress the seal material powder and press the packing against the insulator, whereby the metallic shell and the insulator are assembled together.

In recent years, as a result of a design for increasing the output of an internal combustion engine and decreasing fuel consumption thereof, the size and diameter of a spark plug have been reduced more and more, and the diameter of the insulator used therein has also been reduced.

Therefore, in the case where a structure in which an end portion of the crimp portion of the metallic shell comes into contact with a side surface of the insulator is employed in such a spark plug having a reduced diameter, the following problem may occur. For example, if, at the time of attachment of a spark plug to an internal combustion engine, an attachment tool, such as a wrench, hits against the insulator of the spark plug and the insulator receives an external impact, the insulator may be damaged or broken at a position at which the end portion of the crimp portion is in contact with the insulator and serves as a fulcrum.

In order to prevent such breakage or the like of the insulator, a known spark plug is designed so that, at the time of crimping, only a packing present inside the crimp portion comes into contact with the insulator, and the end portion of the crimp portion does not come into contact with the insulator (see, for example, Patent Document 1).

Patent Document 1: Japanese Patent Application Laid-Open (kokai) No. 2006-92955

DISCLOSURE OF THE INVENTION

Problem to be Solved by the Invention

When combustion gas produces a pushing load acting on the insulator toward the rear end with respect to the axial direction, the packing must sustain the load. If the packing fails to sustain the load, gastightness cannot be secured. Therefore, in general, the packing is required to be formed of a relatively hard material such as metal. Therefore, if the packing is in contact with the insulator as in the invention described in Japanese Patent Application Laid-Open No. 2006-92955, the possibility of the insulator being broken at the position of the packing serving as a fulcrum still remains.

The present invention has been achieved in view of the above circumstances, and an object of the invention is to provide a spark plug which is excellent in impact resistance, as well as a method of manufacturing the same.

Means For Solving the Problems

Configurations suited for achieving the above-mentioned object will next be described individually. If necessary, actions and effects peculiar to individual configurations will be described additionally.

Configuration 1: A spark plug comprising:

a center electrode;

a tubular insulator surrounding the circumference of the center electrode and having, on its outer circumferential surface, a rear trunk portion located on a rear end side thereof, and a large diameter portion located frontward of the rear trunk portion and having a diameter greater than that of the rear trunk portion;

a tubular metallic shell surrounding the circumference of the insulator and accommodating the large diameter portion of the insulator between a stepped portion formed inside the metallic shell and a crimp portion formed at a rear end portion of the metallic shell, to thereby hold the insulator;

a ground electrode provided to form a spark discharge gap in cooperation with the center electrode; and an annular packing interposed between an inner circumferential surface of the crimp portion and an outer circumferential surface of the insulator, the spark plug being characterized in that a cushioning member is interposed between the insulator and at least the crimp portion or the packing, whichever is closer to the insulator.

According to the above-described Configuration 1, the cushioning member can absorb an external impact acting on the insulator. Therefore, as compared with a configuration in which the crimp portion or the packing is in direct contact with the insulator, the possibility of occurrence of breakage or the like of the insulator can be reduced, and impact resistance can be enhanced. In a conventional spark plug, since the insulator is required to have a sufficient strength from the viewpoint of strength of the spark plug, there is a limit to reduction of the diameter of the insulator. In contrast, when the above-described configuration is employed, a spark plug having a smaller diameter can be realized.

Notably, in the case where the packing itself is formed of a relatively soft material, such as resin, when a pushing load produced by combustion gas acts on the insulator, the packing may fail to sustain the pushing load. Therefore, in order to secure durability and gastightness, the packing formed of a relatively hard material such as metal cannot be omitted. Accordingly, the above-described Configuration 1 is effective.

A member which is softer than the crimp portion or the packing, whichever is softer (more easily deformed), is employed as the above-mentioned cushioning member. The difference in softness (hardness) appears as a difference in impact absorbing performance, and impact absorbing performances of different materials can be compared on the basis of the magnitude of energy measured by an impact test such as a known Charpy test.

Configuration 2: A spark plug according to the present configuration is characterized in that, in the above-mentioned configuration 1, the cushioning member is formed from talc powder.

Since talc powder, which has conventionally been used as a seal material for spark plugs, is inexpensive and is excellent in insulating properties and heat resistance, talc powder is suitable for use as the above-mentioned cushioning member. Notably, the expression "the cushioning member is formed from talc powder" encompasses not only the case where the cushioning member is formed from talc powder only, but also the case where the cushioning member is formed mainly from talc powder but other materials (inorganic materials) are mixed thereto.

Configuration 3: A spark plug according to the present configuration is characterized in that, in the above-mentioned configuration 2, the talc powder is charged in a clearance portion surrounded by the inner circumferential surface of the crimp portion, a rear-end-side inner circumferential surface of the metallic shell continuous with the inner circumferential surface of the crimp portion, a rearward facing end surface of the large diameter portion of the insulator, and an outer circumferential surface of the rear trunk portion continuous with the rearward facing end surface; and a radially inner portion of a rear end portion, with respect to the axial direction, of a layer formed of the charged talc powder projects rearward in the axial direction in relation to a radially outer portion of the rear end portion, and the packing is disposed on the radially outer portion.

According to the above-described Configuration 3, a portion (a radially inner portion of the rear end portion with respect to the axial direction) of the layer of charged talc powder, which has conventionally been used, can be used as the above-described cushioning member interposed between the packing and the insulator. Therefore, a separate intervening member is not required to be newly provided, whereby an increase in the number of components can be suppressed.

Notably, in the case where the layer of talc powder is interposed between the packing and the insulator, and is caused to function as a cushioning member, the thickness of the interposed layer of talc powder as measured in the radial direction (the shortest distance between the inner circumferential surface of the packing and the outer circumferential surface of the insulator) J is desirably not greater than the thickness of the packing as measured in the radial direction (the outer diameter of the packing) W, and not less than 0.1 mm ($0.1\ \text{mm} \leqq J \leqq W$). When the thickness J of the layer of talc powder is greater than the thickness W of the packing, the talc powder becomes likely to collapse, and leak to the outside. Therefore, there arises a concern over crimp loosening, lowering of gastightness, and other problems caused by a decrease in the amount of the talc powder. When the thickness J of the layer of talc powder is less than 0.1 mm, the layer of talc powder may fail to sufficiently function as a cushioning member.

In the case where talc powder is used as described above in the configuration in which the crimp portion and the packing are prevented from coming into contact with the insulator, leakage of the talc powder from the clearance between the crimp portion and the insulator must be taken into consideration. In contrast, when a spark plug in which a layer of talc powder is interposed between the packing and the insulator as a cushioning member is configured such that, on the rear end side of the layer of talc powder with respect to the axial direction, an intervening member formed of a relatively soft material (e.g. resin) is interposed between the crimp portion and the insulator, the intervening member functions as a lid to thereby prevent leakage of talc powder, without increasing the possibility of occurrence of breakage or the like of the insulator. As a result, crimp loosening, lowering of gastightness, and other problems, caused by a decrease in the amount of the talc powder can be suppressed.

Configuration 4: A spark plug according to the present configuration is characterized in that, in the above-mentioned configuration 1, the cushioning member is formed from a resin material.

An example of the resin material is PEEK (polyether ether ketone), which is a heat resistant resin. Needless to say, the expression "the cushioning member is formed from a resin material" encompasses not only the case where the cushioning member is formed from a resin material only, but also the case where the cushioning member is formed mainly from a resin material but other materials (inorganic materials) are mixed thereto.

Furthermore, when a spark plug in which a layer of charged talc powder is formed between the metallic shell and the insulator as in a conventional spark plug is configured such that, on the rear end side of the layer of charged talc powder with respect to the axial direction, the above-mentioned cushioning member formed of a resin material is interposed between the packing, etc. and the insulator, the cushioning member not only provides a cushioning function (its primary function) but also functions as a lid for preventing leakage of talc powder from the layer of charged talc powder.

Configuration 5: A spark plug according to the present configuration is characterized in that, in the above-mentioned configuration 4, as viewed in a cross section taken along the axis, the entirety of the cushioning member is located radially inward of a frontmost portion of the packing with respect to the axial direction.

Depending on the temperature of an environment in which the spark plug is used, the aged deterioration of the cushioning member formed of a resin material may proceed quickly. When a clearance is formed because of the aged deterioration of the cushioning member, there arises a concern over crimp loosening and lowering of gastightness. In particular, in the case where the cushioning member formed of a resin material and the packing are superimposed on each other in the axial direction, the influence of the formed clearance is large, and the cushioning member may fail to sustain an axial pushing load which is produced by combustion gas and acts on the insulator. In contrast, in the case where the cushioning member formed of a resin material is disposed on the radially inner side of the packing such that the cushioning member and the packing are not superimposed on one another (do not overlap each other) in the axial direction, the above-described influence can be minimized, and lowering of durability and gastightness can be suppressed. However, even in the case where the cushioning member formed of a resin material is disposed in the above-described manner during manufacture of the spark plug, at the time of crimping, the cushioning member is pushed and deformed by a force acting thereon in a radially inward direction, and a portion of the cushioning member may extend along the surface of the packing to hereby form a thin portion of the cushioning member along the surface of the packing. However, even when this phenomenon is taken into consideration, substantially the same effect as in the case where the cushioning member and the packing are disposed such that they do not overlap each other in the axial direction is attained if the degree of overlapping satisfies at least the requirement of the above-described Configuration 5.

Configuration 6: A spark plug according to the present configuration is characterized in that, in the above-mentioned configuration 4 or 5, as viewed in a cross section taken along the axis, the entirety of the cushioning member is located rearward of a frontmost portion of the packing with respect to the axial direction.

In an internal combustion engine, the temperature of a front end of a spark plug reaches a high temperature of about 800° C. Therefore, in the case of where a layer of charged talc powder is formed between the metallic shell and the insulator as in a conventional spark plug, if the cushioning member formed of a resin material is disposed to extend over a relatively wide range in the axial direction, deterioration of the cushioning member proceeds quickly on the side toward the front end of the spark plug (on the front end side with respect to the axial direction), and a clearance in which the talc powder can move is likely to be formed. Therefore, in the case where the cushioning member formed of a resin material is disposed, it is preferred to dispose the cushioning member only at the vicinity of the crimp portion. In particular, when the cushioning member is disposed as in the above-described Configuration 6, it is possible to suppress the progress of deterioration of the cushioning member to the greatest extent possible, while securing the function of the cushioning member at the minimum required level. Further, even when the cushioning member deteriorates, its influence is very small.

Furthermore, when a spark plug is used, even in the vicinity of the crimp portion, the temperature reaches about 100° C., preferably, the cushioning member formed of a resin material has a heat resistance as described in the following Configuration 7.

Configuration 7: A spark plug according to the present configuration is characterized in that, in any of the above-mentioned configurations 4 to 6, a relative thermal index of the resin material determined in accordance with the UL-746B standard is 100° C. or higher.

Notably, the relative thermal index is defined in the UL-746B standard, and refers to a temperature at which the values of electrical and mechanical properties of a material drop to 50% the original values when the material is maintained at that temperature in the atmosphere for 100,000 hours.

Incidentally, as having been described in the background art section, when the diameter of the spark plug is reduced, the outer diameter of the insulator decreases, and the strength thereof decreases. Therefore, breakage or the like of the insulator becomes more likely to occur. That is, the above-described Configurations 1 to 7 are more effective for spark plugs having a relatively small diameter as shown in the following Configurations 8 to 10.

Configuration 8: A spark plug according to the present configuration is characterized in that, in any of the above-mentioned configurations 1 to 7, the section modulus Z of the insulator at a position facing the crimp portion is 60 or less.

When the insulator is formed to have a relatively small wall thickness and has a section modulus Z of 60 or less, the insulator is likely to be easily broken. Therefore, the above-described Configurations 1 to 7 are highly effective for spark plugs having the feature described in the present Configuration 8.

Configuration 9: A spark plug according to the present configuration is characterized in that, in any of the above-mentioned configurations 1 to 8, the rear trunk portion of the insulator facing the crimp portion has a diameter of 8 mm or less.

Configuration 10: A spark plug according to the present configuration is characterized in that, in any of the above-mentioned configurations 1 to 9, a threaded portion which is formed on the metallic shell for attachment to an internal combustion engine has a nominal diameter of M10 or less.

Configuration 11: A method for manufacturing a spark plug comprising:

a center electrode;

a tubular insulator surrounding the circumference of the center electrode and having, on its outer circumferential surface, a rear trunk portion located on a rear end side thereof, and a large diameter portion located frontward of the rear trunk portion and having a diameter greater than that of the rear trunk portion;

a tubular metallic shell surrounding the circumference of the insulator and accommodating the large diameter portion of the insulator between a stepped portion formed inside the metallic shell and a crimp portion formed at a rear end portion of the metallic shell, to thereby hold the insulator; and a ground electrode provided to form a spark discharge gap in cooperation with the center electrode, wherein talc powder is charged in a clearance portion surrounded by an inner circumferential surface of the crimp portion, a rear-end-side inner circumferential surface of the metallic shell continuous with the inner circumferential surface of the crimp portion, a rearward facing end surface of the large diameter portion of the insulator, and an outer circumferential surface of the rear trunk portion continuous with the rearward facing end surface; and an annular packing is interposed between the inner circumferential surface of the crimp portion and the outer circumferential surface of the rear trunk portion of the insulator, the method being characterized by comprising:

a disposing step of inserting the insulator into the metallic shell from the rear end side thereof with respect to the axial direction so as to dispose the insulator in a state in which the insulator is engaged with an inner circumferential portion of the metallic shell;

a charging step of charging the talc powder into the clearance portion;

a compression step of compressing a layer of the charged talc powder in the axial direction;

a placement step of placing the packing on a rear end portion of the layer of the charged talc powder with respect to the axial direction; and a crimping step of crimping the circumferential edge of the rear end portion of the metallic shell to thereby form the crimp portion, the method further comprising a placement portion forming step of forming, at least before the placement step, a placement portion, on which the packing is to be placed, on a radially outer portion of a rear end portion, with respect to the axial direction, of the layer of the charged talc powder.

In a spark plug manufactured by the manufacturing method of the above-described Configuration 11, talc powder is interposed between the packing or the like and the insulator. That is, according to the above-described Configuration 11, a spark plug which is similar to the spark plug of the above-described Configuration 1 and which is excellent in impact resistance can be manufactured. Furthermore, according to the above-described Configuration 11, a separate intervening member is not required to be newly provided, whereby an increase in the number of components can be suppressed.

Notably, the charging step may be a step of directly charging talc powder into the clearance section, or a step of compacting talc powder in a ring shape to thereby produce a preform (a talc powder ring), and fitting the preform into the clearance portion.

Moreover, the placement portion forming step may be performed, simultaneously with the compression step, by use of a special pressing tool whose end portion is formed into a stepped shape. Alternatively, in the case where a cutting step of adjusting the axial length of the layer of charged talc powder is performed after the compression step, the placement portion forming step may be performed, simultaneously with the cutting step, by use of a special cutting tool whose end portion is formed into a stepped shape. In these cases, it is possible to manufacture a spark plug in which talc powder is interposed between the packing or the like and the insulator, without increasing the number of operation steps.

BEST MODE FOR CARRYING OUT THE INVENTION

First Embodiment

One embodiment of the present invention will next be described with reference to the drawings. FIG. 1 is a partially cutaway front view showing a spark plug 1. In the following description, the direction of an axis C1 of the spark plug 1 in FIG. 1 is referred to as the vertical direction, and the lower side of the spark plug 1 in FIG. 1 is referred to as the front end side of the spark plug 1, and the upper side as the rear end side of the spark plug 1.

The spark plug 1 is composed of an elongated insulator 2, a tubular metallic shell 3 holding the insulator 2, etc.

The insulator 2 has an axial hole 4 extending therethrough along the axis C1. A center electrode 5 is inserted and fixed to a front end portion of the axial hole 4, and a terminal electrode 6 is inserted and fixed to a rear end portion of the axial hole 4. A resistor 7 is disposed in the axial hole 4 to be located between the center electrode 5 and the terminal electrode 6, and opposite end portions of the resistor 7 are electrically connected to the center electrode 5 and the terminal electrode 6 via electrically conductive glass seal layers 8 and 9, respectively.

The center electrode 5 is fixed in a state in which it projects from the front end of the insulator 2, and the terminal electrode 6 is fixed in a state in which it projects from the rear end of the insulator 2. Furthermore, a noble-metal tip 31 is joined, by means of welding, to the front end of the center electrode 5.

Meanwhile, the insulator 2 is formed from alumina or the like by firing, as is well known in the art. The insulator 2 externally includes a large-diameter portion 11, which is located at an approximately center portion with respect to the direction of the axis C1 and projects radially outward; an intermediate trunk portion 12, which is located frontward of the large-diameter portion 11 and is smaller in diameter than the large-diameter portion 11; and a leg portion 13, which is located frontward of the intermediate trunk portion 12, is smaller in diameter than the intermediate trunk portion 12, and is exposed to a combustion chamber of an internal combustion engine (engine). A front end portion of the insulator 2, including the large-diameter portion 11, the intermediate trunk portion 12, and the leg portion 13, is accommodated in the metallic shell 3 formed in a tubular shape. A stepped portion 14 is formed at a connection portion between the leg portion 13 and the intermediate trunk portion 12. The insulator 2 is seated on the metallic shell 3 via the stepped portion 14.

Furthermore, the insulator 2 has a rear trunk portion 10, which is formed on the rear end side of the large diameter portion 11, is smaller in diameter than the large diameter portion 11, and projects outward from a rear end portion of the metallic shell 3.

The metallic shell 3 is formed from a metal such as low-carbon steel (e.g., S25C) into a tubular shape. The metallic shell 3 has a threaded portion (externally threaded portion) 15 on its outer circumferential surface, and the threaded portion 15 is used to attach the spark plug 1 to an engine head. The metallic shell 3 has a seat portion 16 formed on its outer circumferential surface and located on the rear end side of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be attached to the engine head. Further, the metallic shell 3 has a crimp portion 20 provided at its rear end portion and adapted to hold the insulator 2.

The metallic shell 3 has a stepped portion 21 provided on its inner circumferential surface and adapted to allow the insulator 2 to be seated thereon. The insulator 2 is inserted into the metallic shell 3 from the rear end side of the metallic shell 3 toward the front end side thereof. In a state in which the stepped portion 14 of the insulator 2 is engaged with the stepped portion 21 of the metallic shell 3, the circumferential edge of the rear end portion of the metallic shell 3 is crimped radially inward; i.e., the above-mentioned crimp portion 20 is formed, whereby the insulator 2 is fixed in place. Notably, an annular sheet packing 22 is disposed between the stepped portions 14 and 21 of the insulator 2 and the metallic shell 3, respectively. This retains gastightness of the combustion chamber and prevents leakage, to the exterior of the spark plug 1, of an air-fuel mixture which enters a clearance between the inner circumferential surface of a front end portion of the metallic shell 3 and the leg portion 13 of the insulator 2, which leg portion 13 is exposed to the combustion chamber.

Further, in order to ensure gastightness which is established by crimping, as will be described later, annular wire packings 23 and 24, each having a circular cross section, are disposed between the metallic shell 3 and the insulator 2 in a region near the rear end of the metallic shell 3, and talc powder 25 is charged in the space between the wire packings 23 and 24. Accordingly, the insulator 2 is held by the metallic shell 3 via the sheet packing 22, the wire packings 23 and 24, and the talc powder 25.

Also, a generally L-shaped ground electrode 27 is joined to a front end surface 26 of the metallic shell 3. Specifically, a rear end portion of the ground electrode 27 is welded to the front end surface 26 of the metallic shell 3, and a front end portion of the ground electrode 27 is bent such that a side surface of the front end portion faces a front end portion (the noble-metal tip 31) of the center electrode 5. A noble-metal tip 32 is provided on the ground electrode 27 so that the noble-metal tip 32 faces the noble-metal tip 31. The gap between the noble-metal tips 31 and 32 serves as a spark discharge gap 33.

The center electrode 5 is reduced in diameter at its front end, assumes a rodlike (circular columnar) shape as a whole, and has a flat front end surface. The above-mentioned noble-metal tip 31, which assumes a circular columnar shape, is placed on the front end surface, and laser welding, electron beam welding, resistance welding, or the like is performed along the outer edge of a joint surface of the noble-metal tip 31, whereby the noble-metal tip 31 and the center electrode 5 are joined together. Meanwhile, the noble-metal tip 32, which is to face the noble-metal tip 31, is joined to the ground electrode 27 by means of positioning the noble-metal tip 32 at a predetermined position on the ground electrode 27, and welding the noble-metal tip 32 along the outer edge of a joint surface of the noble-metal tip 32. Notably, one or both of the noble-metal tip 31 and the noble-metal tip 32 facing thereto may be omitted. In this case, the spark discharge gap 33 is formed between the noble-metal tip 31 and the ground electrode 27 or between the noble-metal tip 32 and the center electrode 5.

Here, the structure of the rear end portion (the crimp portion 20) of the metallic shell 3 and its vicinity will be described in detail. FIG. 2 is a partially cutaway front view showing, on an enlarged scale, a main characteristic portion of the metallic shell 3 in the vicinity of the rear end portion thereof.

A talc charged layer 36 formed of the talc powder 25 is formed in a clearance portion 35, which is surrounded by an inner circumferential surface 20*a* of the crimp portion 20, a rear-end-side inner circumferential surface 19*a* of the metallic shell 3 (an inner circumferential surface of the tool engagement portion 19) continuous with the inner circumferential surface 20*a*, a rearward facing end surface 11*a* of the large diameter portion 11 of the insulator 2, and an outer circumferential surface 10*a* of the rear trunk portion 10 continuous with the end surface 11*a*.

The wire packings 23 and 24 are disposed at opposite ends of the talc charged layer 36 with respect to the direction of the axis C1. Of the two wire packings 23 and 24, the rear-end-side wire packing 23 is disposed in contact with the inner circumferential surface of the crimp portion 20, and the front-end-side wire packing 24 is disposed in contact with the rearward facing end surface 11*a* of the large diameter portion 11 of the insulator 2 and the rear-end-side inner circumferential surface 19*a* of the metallic shell 3. That is, the rear-end-side wire packing 23 corresponds to the packing in the present embodiment.

The wire packings 23 and 24 are formed of a metal material such as soft iron or copper. Accordingly, whereas the metallic shell 3 (the crimp portion 20), which is generally formed of a low carbon steel (S15C to S35C) or the like, has a hardness of about HV180 to HV300 in Vickers hardness, the wire packings 23 and 24 have a hardness of about HV100 to HV150 in Vickers hardness.

Furthermore, in the present embodiment, the crimp portion 20 and the insulator 2 (the rear trunk portion 10) are separated from each other, and are in a non-contact state. Moreover, a portion (a radially inner portion 36*a* to be described later) of the talc charged layer 36 is present between the wire packing 23 and the rear trunk portion 10 of the insulator 2. Therefore, the wire packing 23 is also in a non-contact state with the rear trunk portion 10 of the insulator 2.

Next, a method of manufacturing spark plug 1 configured as described above will be described. First, the metallic shell 3 (a metallic shell intermediate 3') is produced in advance. That is, cold forging operation is performed on a cylindrical columnar metal material (e.g., iron material or stainless steel material such as S17C) so as to form a through hole therein and impart a rough shape to the metal material. Subsequently, a cutting operation is performed on the metal material so as to impart a predetermined outer shape to the metal material, whereby the metallic shell intermediate 3' is obtained. Notably, needless to say, in this state, a rear end portion of the metallic shell intermediate 3' is in an un-crimpled state, the crimp portion 20 is not formed, and the rear end portion assumes the form of a straight cylindrical tube, as shown in FIG. 3, etc.

Subsequently, the ground electrode 27, which is formed of a nickel alloy (for example, an inconel alloy or the like), is resistance-welded to the front end surface of the metallic shell intermediate 3'. After that, by means of form rolling, the threaded portion 15 is formed on the metallic shell intermediate 3' at a predetermined position. As a result, the metallic shell intermediate 3' with the ground electrode 27 welded thereto is obtained. Zinc plating or nickel plating is performed for the metallic shell intermediate 3' with the ground electrode 27 welded thereto. Notably, in order to enhance corrosion resistance, the surface of the metallic shell intermediate may be treated with chromate.

Moreover, the above-mentioned noble-metal tip 32 is joined to the distal end portion of the ground electrode 27 through resistance welding, laser welding, or the like.

Meanwhile, separately from the metallic shell intermediate 3', the insulator 2 is produced through molding. For example, material granules for molding are prepared from material powder containing alumina (predominant component), binder, etc. A tubular compact is obtained by performing rubber press molding while using the material granules. Grinding is performed on the obtained compact for trimming. The trimmed compact is placed in a firing furnace, and is fired, whereby the insulator 2 is obtained.

Further, separately from the metallic shell intermediate 3' and the insulator 2, the center electrode 5 is manufactured. That is, a nickel alloy, in which a copper alloy is placed at a center portion thereof in order to improve heat radiation performance, is forged so as to fabricate the center electrode 5. Then, the above-mentioned noble-metal tip 31 is joined to the front end surface of the center electrode 5 by means of resistance welding, laser welding, or the like.

The insulator 2 and the center electrode 5, which have been fabricated as described above, the resistor 7, and the terminal electrode 6 are fixed together and sealed by means of the glass seal layers 8 and 9. In general, the glass seal layers 8 and 9 are formed as follows. A powder mixture, prepared through mixing borosilicate glass powder and metal powder, is charged into the axial hole 4 of the insulator 2 so that the resistor 7 is sandwiched by the powder mixture, and the terminal electrode 6 is then inserted and pressed from the rear side. In this state, the powder mixture is baked within a firing furnace. Notably, at that time, a glaze layer may be simultaneously formed on the surface of the rear trunk portion 10 of the insulator 2 through firing. Alternatively, the glaze layer may be formed in advance.

After that, the insulator 2 having the center electrode 5 and the terminal electrode 6, which has been fabricated as described above, is combined with the metallic shell intermediate 3' having the ground electrode 27, which has been fabricated as described above. Specifically, the sheet packing 22 is inserted into the metallic shell intermediate 3' through the rear-end-side opening of the metallic shell intermediate 3', and is placed on the stepped portion 21. Subsequently, the insulator 2 is inserted into the metallic shell intermediate 3' from the rear end side of the metallic shell intermediate 3' toward the front end side thereof, and disposed in a state in which the stepped portion 14 of the insulator 2 is engaged with the stepped portion 21 of the metallic shell intermediate 3' (disposing step).

Subsequently, the wire packing 24 is inserted into a clearance 35' (a space which will form the clearance portion 35 later) which is open toward the rear end of the metallic shell intermediate 3', and is disposed in contact with the rearward facing surface 11*a* of the large diameter portion 11 of the insulator 2 and the rear-end-side inner circumferential surface 19*a* of the metallic shell intermediate 3'.

Subsequently, as shown in FIG. 3, the talc powder 25 is charged into the clearance 35' (the clearance portion 35) so as to form the talc charged layer 36 (charging step). Specifically, in the present embodiment, the talc charged layer 36 is formed by a method in which material granules for molding are prepared from material powder containing the talc powder 25 (predominant component), binder, etc., and are compacted into a ring shape to thereby produce a preform (a talc powder ring), which is then inserted into the clearance 35'. Needless to say, instead of the above-described method, there can be employed a method in which the talc powder 25 is charged directly into the clearance 35' without performance of preforming.

After that, as shown in FIG. 4, the talc charged layer 36 (the talc powder 25) is compressed in the direction of the axis C1 by use of a tubular punch 40, to thereby increase the filling density (compression step).

Next, as shown in FIG. 5, in order to adjust the height of the talc charged layer 36, a cutting operation for cutting a rear end portion of the talc charged layer 36 is performed (cutting step). For this cutting operation, a tubular rotary cutter 41 having a stepped end is used. As result of the cutting operation performed by use of the cutter, the rear end portion of the talc charged layer 36 is formed into a stepped shape. Specifically, a recess-like placement portion 43 is formed on the radially outer side of the rear end portion, and only a radially inner portion 36*a* thereof projects rearward. Accordingly, in the present embodiment, a placement portion forming operation (placement portion forming step) is performed simultaneously with the cutting operation (the cutting step).

As shown in FIG. 6, the wire packing 23 is then placed on the placement portion 43 formed in the rear end portion of the talc charged layer 36 (placement step), followed by a crimping step shown in FIG. 7.

In the crimping step, a pressure is applied, in the direction of the axis C1, to a portion of the metallic shell intermediate 3' located rearward of the seat portion 16, by use of a crimping die 45 for pushing, from above, the circumferential edge of the rear end portion of the metallic shell intermediate 3', and a base die 46 for supporting the seat portion 16 of the metallic shell intermediate 3' from below.

With this crimping operation, a thin wall portion 29 of the metallic shell intermediate 3' located between the seat portion 16 and the tool engagement portion 19 is deformed radially outward, and the circumferential edge of the rear end portion of the metallic shell intermediate 3' is bent radially inward and compressed, whereby the crimp portion 20 is formed. As a result, the talc charged layer 36 is compressed in the direction of the axis C1 between the crimp portion 20 and the large diameter portion 11 of the insulator 2; i.e., between the two wire packings 23, and 24; and the stepped portion 14 of the insulator 2 is pressed against the stepped portion 21 of the metallic shell 3 via the sheet packing 22, whereby the insulator 2 is firmly fixed to the metallic shell 3 to form a unit.

At that time, the front-end-side wire packing 24 expands radially outward as a result of the talc charged layer 36 (the talc powder 25) being pressed downward. In contrast, the rear-end-side wire packing 23 contracts radially inward because the deforming crimp portion 20 pushes the wire packing 23 radially inward. As a result, the radially inner portion 36*a*, which remains uncut in the rear end portion of the talc charged layer 36, is interposed, as a cushioning member, between the wire packing 23 and the rear trunk portion 10 of the insulator 2.

The spark plug 1 is completed through such a series of steps.

As having been described in detail, in the present embodiment, the crimp portion 20 and the insulator 2 are separated from each other; and a portion of the talc charged layer 36 formed of the talc powder 25 is interposed between the wire packing 23 and the rear trunk portion 10 of the insulator 2. That is, the radially inner portion 36*a* of the talc charged layer 36, which is higher in impact-absorbing performance than the wire packing 23, functions as a cushioning member, and can absorb an external impact acting on the insulator 2. Thus, as compared with a structure in which the crimp portion 20 or the wire packing 23 is in direct contact with the insulator 2, the possibility of breakage or the like of the insulator 2 can be reduced, and impact resistance can be enhanced. These effects were able to be confirmed through tests to be described later.

Furthermore, in the present embodiment, since a portion of the talc charged layer 36, which has been conventionally used, is used as a cushioning member, a separate intervening member is not required to be newly provided, whereby an increase in the number of components can be suppressed.

Notably, in the case where the radially inner portion 36*a* of the talc charged layer 36 is interposed between the wire packing 23 and the insulator 2 and caused to function as a cushioning member, preferably, a relation $0.1\ \text{mm} \leqq J \leqq W$ is satisfied, wherein J (mm) is the thickness of the interposed radially inner portion 36*a*; i.e., the shortest distance in the radial direction between the minimum inner diameter portion of the wire packing 23 and the outer circumferential surface 10*a* of the rear trunk portion 10 of the insulator 2; and W (mm) is the outer diameter of the wire packing 23. When the thickness J of the radially inner portion 36*a* is greater than the outer diameter W of the wire packing 23, the talc powder 25, which constitutes the radially inner portion 36*a*, becomes likely to collapse, and likely to leak to the outside. Therefore, there arises a concern over crimp loosening, lowering of gastightness, and other problems, caused by a decrease in the amount of the talc powder 25. When the thickness J of the radially inner portion 36*a* is less than 0.1 mm, the radially inner portion 36*a* may fail to sufficiently function as a cushioning member.

Second Embodiment

A second embodiment, which differs from the above-described first embodiment, will now be described with reference to the drawings. However, the same components as the first embodiment are denoted by the same reference numerals, and their detailed descriptions will not be repeated.

Unlike the first embodiment, in which a portion of the talc charged layer 36 formed of the talc powder 25 is interposed, as a cushioning member, between the wire packing 23 and the rear trunk portion 10 of the insulator 2, in the present embodiment, a resin ring 50 serving as a cushioning member is interposed between the wire packing 23 and the rear trunk portion 10 of the insulator 2, as shown in FIG. 8. The resin ring 50 used in the present embodiment is formed of PEEK, 66 Nylon (registered trademark), or a like heat resisting resin whose relative thermal index defined under the UL-746B standard is 100° C. or higher. Notably, in the case where the resin ring 50 is formed of PEEK, the resin ring 50 has a Rockwell hardness of 120 (R scale) or 90 to 100 (M scale), and in the case where the resin ring 50 is formed of 66 Nylon, the resin ring 50 has a Rockwell hardness of 110 (R scale).

In a process of manufacturing the spark plug 1 of the present embodiment, as in the case of the above-described first embodiment, the talc powder 25 is first charged into the clearance 35' to thereby form the talc charged layer 36, and the talc charged layer 36 (the talc powder 25) is then compressed in the direction of the axis C1 (corresponding to the steps shown in FIGS. 3 and 4).

In a subsequently performed cutting operation, unlike the above-described first embodiment, a rotary cutter 51 having a flat end, which is the same as those conventionally used, is used as shown in FIG. 9. That is, in the present embodiment, the rear end portion of the talc charged layer 36 is formed into a flat shape.

After placement of the resin ring 50 on the rear end portion of the talc charged layer 36 (see FIG. 10), the wire packing 23 is placed on the radially outer side of the resin ring 50 (see FIG. 11). After that, a crimping step is performed, whereby the spark plug 1 is completed.

Notably, in the crimping step, the resin ring 50 disposed on the radially inner side of the wire packing 23 is deformed by a radially inward force applied from the wire packing 23, and, as shown in FIG. 8, portions of the resin ring 50 extend along the surface of the wire packing 23 to thereby form thin portions therealong. Notably, the spark plug 1 is designed such that, when completed, the entirety of the resin ring 50 is located radially inward of a frontmost portion P1 of the wire packing 23 with respect to the direction of the axis C1, and is located rearward of the portion P1 with respect to the direction of the axis C1.

By virtue of the above-described structure, action and effects similar to those of the first embodiment are attained. As in the case of the first embodiment, the effects of the present embodiment were able to be confirmed through the tests to be described later.

Furthermore, in the present embodiment, since the resin ring 50 functions as a lid, leakage of the talc powder 25 from the talc charged layer 36 can be prevented. As a result, crimp loosening, lowering of gastightness, and other problems caused by a decrease in the amount of the talc powder 25 can be suppressed.

Incidentally, depending on the temperature of an environment in which the spark plug 1 is used, the aged deterioration of the resin ring 50 proceeds quickly. When a clearance is formed as a result of the aged deterioration of the resin ring 50, there arises a concern over the above-described crimp loosening and lowering of gastightness.

In order to minimize the such concern, in the present embodiment, the entirety of the resin ring 50 is located radially inward of the frontmost portion P1 of the wire packing 23 with respect to the direction of the axis C1, and is located rearward of the portion P1 with respect to the direction of the axis C1. Thus, it becomes possible for the resin ring 50 to function as a cushioning member at the minimum required level, and suppress the progress of deterioration to a possible extent. In addition, since the area through which the resin ring 50 and the wire packing 23 engage each other in the direction of the axis C1 is small, even when the resin ring 50 deteriorates, the resistance to the pushing load acting on the insulator 2 is unlikely to decrease.

[Evaluation Test 1: On the Effects of the Two Embodiments]

Next, there will be described results of a test which was performed for Examples 1 to 3 and Comparative Example so as to confirm the effects of the present invention; i.e., the effects of the spark plugs 1 of the above-described first and second embodiments. The test was performed so as to find the relation between the type of an intervening member interposed between the insulator 2 and the wire packing 23 as a cushioning member (including the case where the intervening member is not provided) and fracture energy at which the insulator 2 breaks. Notably, each of the spark plugs of Examples 1 to 3 and Comparative Example was manufactured with the nominal diameter of the threaded portion of the metallic shell 3 set to 10 mm, the outer diameter of the rear trunk portion 10 (in particular, a portion thereof facing the inner end 20*b* of the crimp portion 20) of the insulator 2 set to 8 mm, and the inner diameter of the axial hole 4, in which the resistor 7 and the glass seal layers 8 and 9 are provided, set to 3 mm.

Notably, the fracture energy at which the insulator 2 fractures was measured by a known Charpy test. The Charpy test will be generally described below. Each spark plug 1 is oriented such that the axis C1 of the spark plug 1 extends vertically and the spark discharge gap 33 is directed downward, and is fixed to a test stand by screwing the threaded portion 15 of the metallic shell 3 into a threaded hole of the test stand. Further, a hammer is swingably provided such that its pivot point is located on the axis C1 and above the spark plug 1. The position of the hammer is determined such that when the hammer is allowed to swing by means of free fall after the lifted end of the hammer is released, the end of the hammer collides with the insulator 2 of the spark plug 1 at a position 2*b* (see FIG. 1) about 1 mm away from the rear end 2*a* of the insulator 2. The end of the hammer was caused to collide with the insulator 2, while the lift angle of the hammer (the angle in relation to the direction of the axis C1) was increased in increments of a predetermined angle. This operation was repeated, and the fracture energy was obtained on the basis of the lift angle at which the insulator 2 was broken.

In the test, 100 sample spark plugs each including the same type of an intervening member interposed between the insulator 2 and the wire packing 23 were manufactured; the Charpy test was performed for each sample spark plug; and the average of the fracture energies of the 100 sample spark plugs was calculated. Table 1 shows the results of the test. Each sample spark plug was manufactured with the Vickers hardness of the crimp portion 20 of the metallic shell 3 set to HV180, and the Vickers hardness of the wire packing 23 set to HV120.

TABLE 1

| | Example 1 (66 Nylon) | Example 2 (PEEK) | Example 3 (talc) | Comparative Example (no intervening member) |
|---|---|---|---|---|
| Fracture energy (J) | 0.77 | 0.74 | 0.62 | 0.2 |

In Examples 1 and 2, the resin ring 50 formed of a resin material (66 Nylon, PEEK) was interposed between the insulator 2 and the wire packing 23. In Example 3, the talc powder 25, constituting the talc charged layer 36, was interposed between the insulator 2 and the wire packing 23. In contrast, in Comparative Example, no intervening member was interposed between the insulator 2 and the wire packing 23; that is, the spark plugs of Comparative Example were conventional spark plugs in which the wire packing 23 was in direct contact with the insulator 2.

As shown in Table 1, the fracture energy of the insulator 2 was 0.77 (J) in Example 1, 0.74 (J) in Example 2, 0.62 (J) in Example 3, and 0.2 (J) in Comparative Example. These measured values are those obtained when the insulator 2 fractured in the vicinity of the crimp portion 20.

These results reveal that, irrespective of the type of an intervening member, through employment of a structure in which an intervening member higher in impact absorbing performance than at least the crimp portion 20 and the wire packing 23 is interposed between the insulator 2 and the wire packing 23 as a cushioning member, the actions and effects of the above-described embodiments can be attained; that is, a larger energy is required to fracture the insulator 2, and breakage or the like of the insulator 2 becomes less likely to occur.

[Evaluation Test 2: On the Relation Between the Section Modulus of the Insulator and the Effect of the Invention]

Next, there will be described a test which was performed so as to confirm the relation between the section modulus of the insulator 2 of the spark plugs 1 of the above-described first embodiment and the effect of the present invention. In the test, while the outer diameter of the rear trunk portion 10 of the insulator 2 was varied from 6.8 mm to 10.1 mm, eight groups of 30 insulators were prepared such that the respective groups of insulators had section moduluses of 30, 40, 45, 50, 60, 70, 80, and 100. Subsequently, there was manufactured a spark plug in which a portion of the talc charged layer 36 was used as a cushioning member as in the case of the first embodiment, and one of the prepared insulators was used. The thickness of the portion of the talc charged layer 36 is 0.3 mm. The Charpy test was carried out for the sample spark plugs by use of a Charply tester, with the energy to be applied to each sample spark plug set to 0.4 J. The relation between the section modulus and the effect of the present invention was confirmed on the basis of the ratio of sample spark plugs which did not break. Notably, each of the sample spark plugs were manufactured, with the clearance between the inner end 20*b* of the crimp portion 20 and the rear trunk portion 10 of the insulator 2 set to a fixed size (0.3 mm), and the diameter of the axial hole 4 set to 3 mm. That is, in order to investigate only the relation between the section modulus of the insulator 2 and the effect of the invention, comparison was performed among samples which differed only in the outer diameter of the rear trunk portion 10. The results of this test are shown in Table 2, FIG. 19, and FIG. 20. FIG. 19 shows the results of the above-described test performed on conventional spark plugs including no cushioning member. FIG. 20 shows the results of the above-described test performed on spark plugs of the present invention each having a cushioning member.

TABLE 2

| | Section modulus Z | | | | | | | |
|---|---|---|---|---|---|---|---|---|
| | 29.7 | 40.4 | 45.6 | 51.2 | 61.5 | 70.7 | 80.7 | 100.4 |
| Insulator outer diameter (mm) | 6.8 | 7.5 | 7.8 | 8.1 | 8.6 | 9 | 9.4 | 10.1 |
| Insulator inner diameter (mm) | 3 | 3 | 3 | 3 | 3 | 3 | 3 | 3 |

TABLE 2-continued

| | Section modulus Z | | | | | | | |
|---|---|---|---|---|---|---|---|---|
| | 29.7 | 40.4 | 45.6 | 51.2 | 61.5 | 70.7 | 80.7 | 100.4 |
| *The number of non-defectives (no cushioning member) | 0 | 0 | 0 | 2 | 3 | 20 | 26 | 28 |
| The number of non-defectives (cushioning member: talc) | 29 | 30 | 30 | 30 | 30 | 30 | 30 | 30 |
| Effect ratio | ∞ | ∞ | ∞ | 15 | 10 | 1.5 | 1.2 | 1.1 |

"*The number of non-defectives" represents the number of non-defective spark plugs which fall outside the scope of the present invention.

"The number of non-defectives" in Table 2 indicates the number of spark plugs whose insulator 2 did not break during the above-mentioned Charpy test. That is, in the case of spark plugs to which the present invention was not applied, breakage of the insulator 2 did not readily occur in spark plugs whose insulators 2 were formed to be relatively thick such that the section modulus Z become 70 or greater, but, most of spark plugs whose insulators 2 had a section modulus Z of 60 or less were broken. In contrast, in the case of spark plugs to which the present invention was applied, breakage occurred in almost none of the spark plugs whose insulators 2 had a section modulus Z of 30 to 100. From the above, it can be said that the present invention is highly effective for spark plugs which use an insulator whose section modulus Z is 60 or less. Notably, the "effect ratio" refers to the ratio of the number of non-defective spark plugs (having a cushioning member) according to the present invention to the number of non-defective conventional spark plugs (having no cushioning member).

Notably, the section modulus is calculated as follows. The insulator 2 of a spark plug to be measured is cut in the radial direction at a position corresponding to the inner end 20*b* of the crimp portion 20 (indicated by a broken line A in FIG. 1), and the outer and inner diameter of the insulator 2 are measured from the cross section. Notably, in the case where a glaze layer is present on the insulator 2, the diameter of the insulator 2, including the glaze layer, is measured. Further, the inner diameter is the inner diameter of the insulator 2 itself irrespective of whether or not the glass seal layer and the terminal electrode are present. The section modulus Z is derived from the measured outer diameter D and inner diameter d in accordance with the following formula (Mathematical expression 1).

$$Z=0.0982\times(D^4-d^4)/D \quad \text{[Mathematical expression 1]}$$

Notably, the present invention is not limited to the above-described embodiments, but may be embodied, for example, as follows.

(a) The shape, dimension, etc., of the spark plug 1 are not limited to those employed in the above-described embodiments. For example, the present invention can be embodied as a spark plug of a type in which a plurality of ground electrodes are provided. Furthermore, although not specifically described in the above-described embodiments, the present invention can be applied to spark plugs 1 of any diameter. However, the smaller the diameter of the spark plug 1, the smaller the outer diameter of the insulator 2, and the higher the possibility of occurrence of breakage or the like. Therefore, the effect of the present invention becomes more remarkable when the present invention is applied to spark plugs 1 having a relatively small diameter, such as those in which the diameter of the trunk portion 10 of the insulator 2 is 8 mm or less, and those in which the nominal diameter of the threaded portion of the metallic shell 3 is M10 or less.

(b) In the above-described embodiments, the radially inner portion 36*a* of the talc charged layer 36 or the resin ring 50 is interposed between the wire packing 23 and the rear trunk portion 10 of the insulator 2 as a cushioning member. However, the present invention is not limited to such a structure. For example, a structure as shown in FIGS. 12 and 13 may be employed, in which the radially inner portion 36*a* of the talc charged layer 36 or the resin ring 50 extends rearward so that the radially inner portion 36*a* or the resin ring 50 is interposed between the crimp portion 20 and the rear trunk portion 10 of the insulator 2.

Further, as shown in FIG. 14, the structures of the above-described first and second embodiments may be combined. In the modification shown in FIG. 14, the radially inner portion 36*a* of the talc charged layer 36 is interposed between the wire packing 23 and the rear trunk portion 10 of the insulator 2; and the resin ring 50 is disposed on the rear end of the radially inner portion 36*a*, and is interposed between the crimp portion 20 and the rear trunk portion 10 of the insulator 2. In this case, the radially inner portion 36*a* of the talc charged layer 36 substantially functions as a cushioning member, and the resin ring 50 mainly functions as a lid for preventing leakage of the talc powder 25 from the talc charged layer 36.

(c) In the above-described second embodiment, the entirety of the resin ring 50 is located radially inward of the frontmost portion P1 of the wire packing 23 with respect to the direction of the axis C1, and is located rearward of the portion P1 with respect to the direction of the axis C1. However, no limitation is imposed on the position of the resin ring 50. For example, the second embodiment may be configured such that a portion of the resin ring 50 extends frontward beyond the above-mentioned portion P1 of the wire packing 23. Furthermore, the second embodiment may be configured such that, at the time of crimping, the resin ring 50 is deformed by the wire packing 23, and a portion of the resin ring 50 extends radially outward beyond the above-mentioned portion P1 of the wire packing 23 to form a thin portion therealong. However, when crimp loosening and lowering of gastightness caused by aged deterioration of the resin ring 50 are considered, the structure of the above-described second embodiment is preferred.

(d) In the above-described embodiments, the talc charged layer 36 formed of the talc powder 25 is provided. However, the talc charged layer 36 may be omitted. For example, a structure shown in FIG. 15 may be employed. In the structure shown in FIG. 15, the crimp portion 20 is engaged with the rearward facing end surface 11*a* of the large diameter portion 11 of the insulator 2 via the wire packing 23, and the resin ring 50 is interposed between the crimp portion 20 and the wire packing 23 and the rear trunk portion 10 of the insulator 2. A spark plug in which the talc charged layer 36 is omitted as described above is lower in impact absorbing performance than those having the talc charged layer 36, and is more likely to suffer breakage or the like of the insulator 2. Therefore, the present invention is more effective for such a spark plug in which the talc charged layer 36 is omitted.

Furthermore, the crimping operation performed so as to manufacture the spark plug in which the talc charged layer 36 is omitted and the spark plugs 1 of the above-described embodiments may be cold crimping or hot crimping.

(e) The material of the intervening member (cushioning member) is not limited to talc powder, PEEK, 66 Nylon, etc. mentioned in the above-described embodiments. Any intervening member may be employed so long as the material of the intervening member is higher in impact absorbing performance than at least the wire packing 23 and the metallic shell 3 (the crimp portion 20). For example, an intervening member formed of a metal may be employed.

(f) In the above-described embodiments, the wire packing 23, formed of a metal material such as soft iron or copper and having a circular cross section, is employed as a packing which comes into engagement with the crimp portion 20. However, the shape and material of the wire packing 23 are not limited thereto. For example, a packing formed of a material harder than the metallic shell 3 (the crimp portion 20) may be employed. Furthermore, a packing having a rectangular cross section rather than a circular cross section may be employed, and a sheet packing may be employed in place of the wire packing.

(g) In the above-described first embodiment, when the talc charged layer 36 is formed, the talc charged layer 36 is compressed in the direction of the axis C1, and then a cutting operation for cutting the rear end portion of the talc charged layer 36 is performed. Further, simultaneously with the cutting operation, the placement portion 43, on which the wire packing 23 is placed, is formed in the rear end portion of the talc charged layer 36. Alternatively, the placement portion 43 may be formed, simultaneously with compression of the talc charged layer 36, by use of a special pressing tool whose end portion is formed into a stepped shape.

(h) In the above-descried second embodiment, after placement of the resin ring 50 on the rear end portion of the talc charged layer 36 (see FIG. 10), the wire packing 23 is placed directly on the rear end portion of the talc charged layer 36 to be located on the radially outer side of the resin ring 50 (see FIG. 11). However, the manufacturing method is not limited thereto. For example, a manufacturing method shown in FIG. 16 can be employed. In the method shown in FIG. 16, after the resin ring 50 is placed on the rear end portion of the talc charged layer 36, the wire packing 23 is placed such that the wire packing 23 is supported by a rear end portion of the resin ring 50 and the inner circumferential surface of the metallic shell intermediate 3'. In this case, in a crimping step, as shown in FIG. 17, the wire packing 23 is pushed frontward with respect to the direction of the axis C1 into a space between the resin ring 50 and the inner circumferential surface of the metallic shell intermediate 3', while pushing and deforming the resin ring 50 inward with respect to the radial direction.

(i) In the above-described second embodiment, the resin ring 50, which is formed to have a rectangular cross section before crimping (before deformation), is employed. Needless to say, the shape of the resin ring 50 is not limited thereto. For example, as shown in FIG. 18, a resin ring which has a triangular cross section before crimping may be employed.

DESCRIPTION OF REFERENCE NUMERALS

Figure 1:
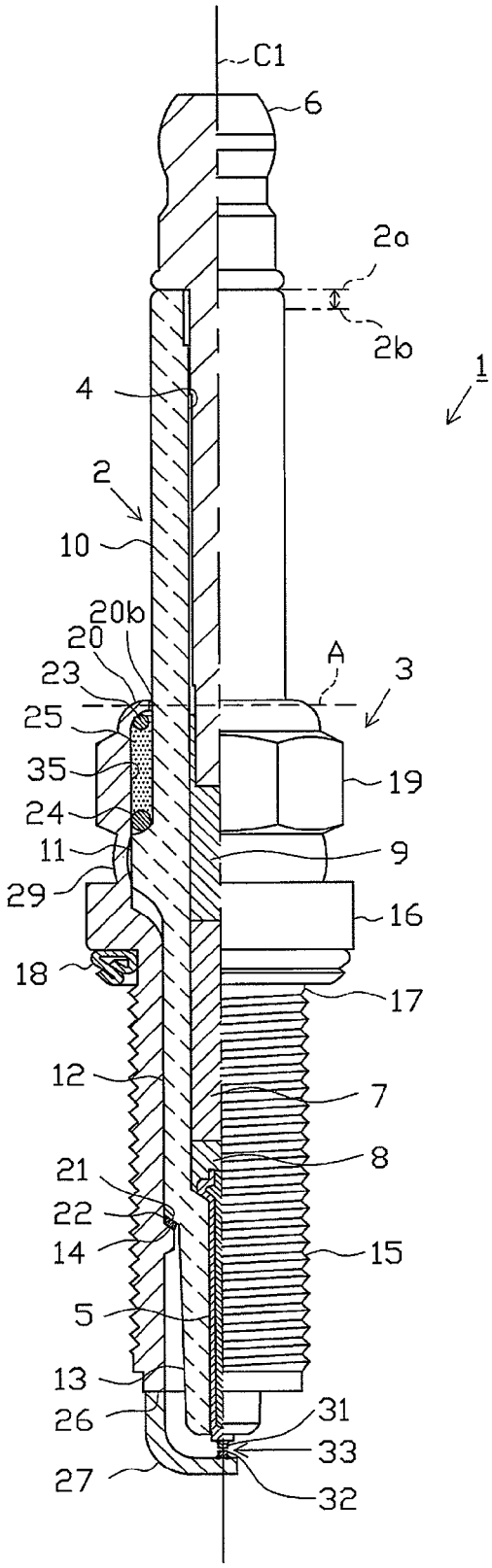
FIG. 1 Partially cutaway front view showing the entirety of a spark plug.
Figure 2:
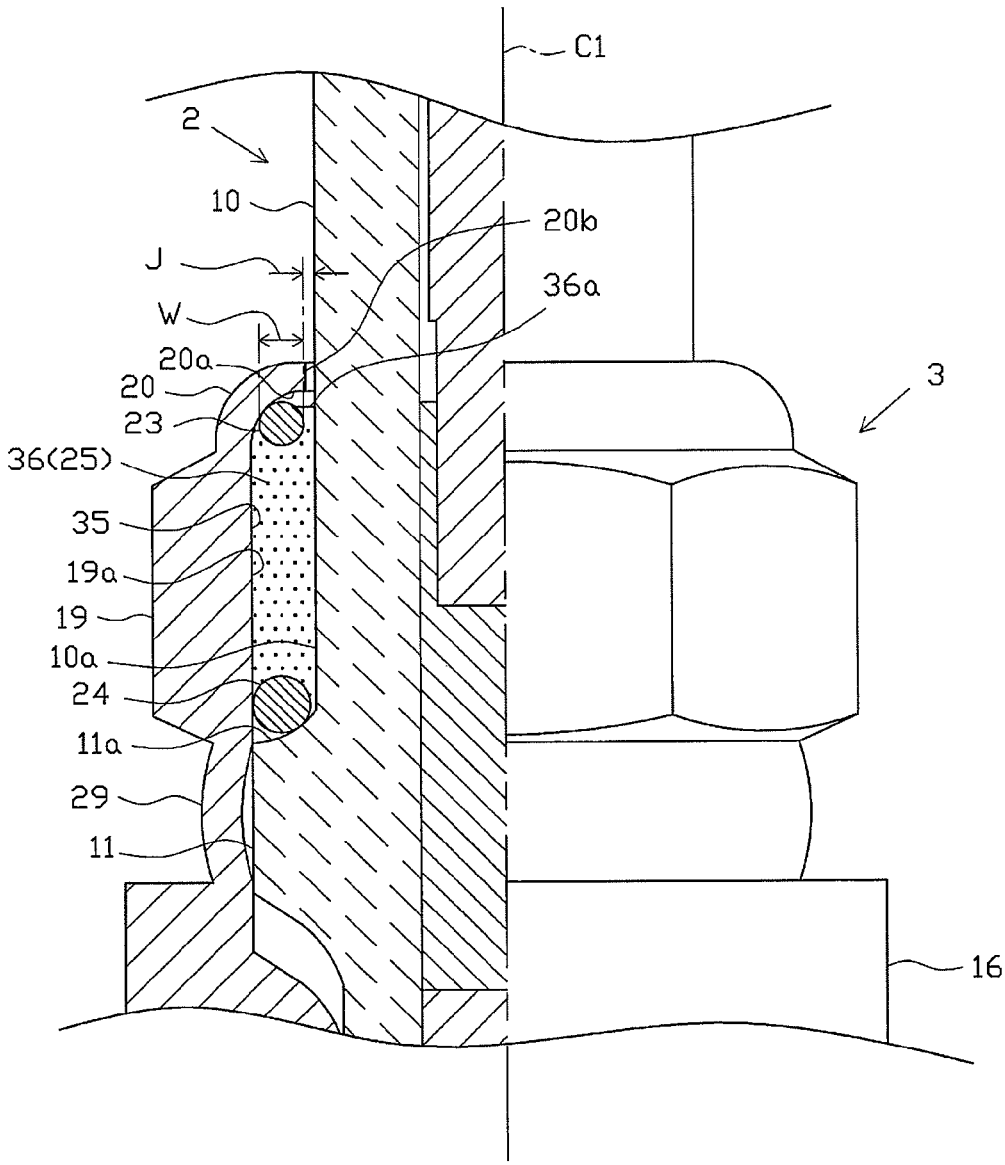
FIG. 2 Partially cutaway front view showing, on an enlarged scale, a main characteristic portion of a metallic shell in the vicinity of a rear end portion thereof.
Figure 3:
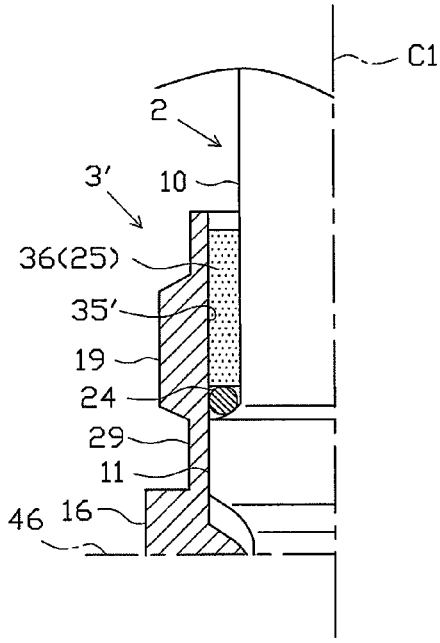
FIG. 3 Explanatory view showing a step of charging talc powder.
Figure 4:
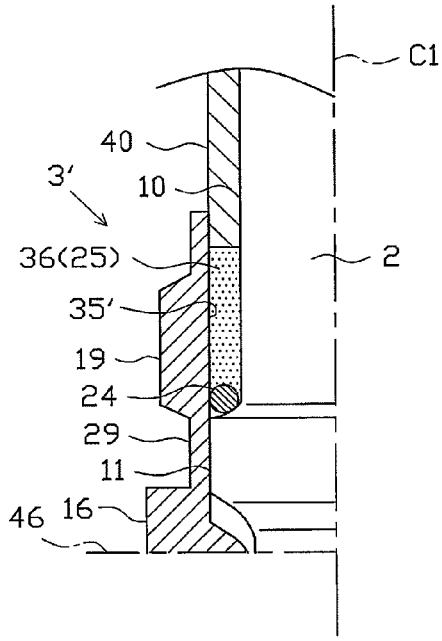
FIG. 4 Explanatory view showing a step of compressing a talc charged layer (talc powder).
Figure 5:
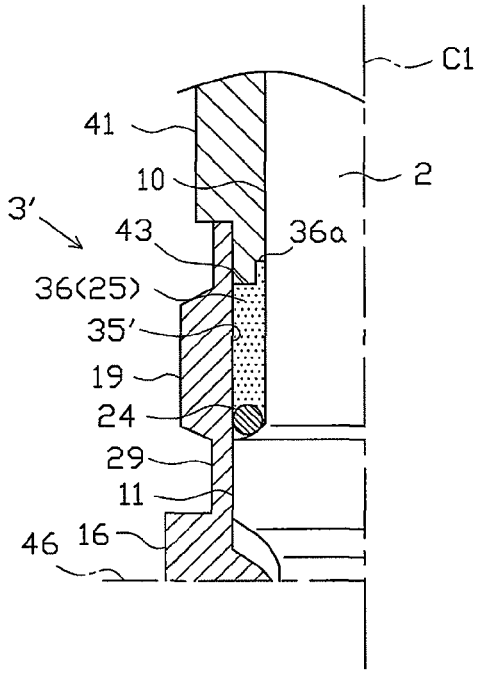
FIG. 5 Explanatory view showing a step of cutting the talc charged layer.
Figure 6:
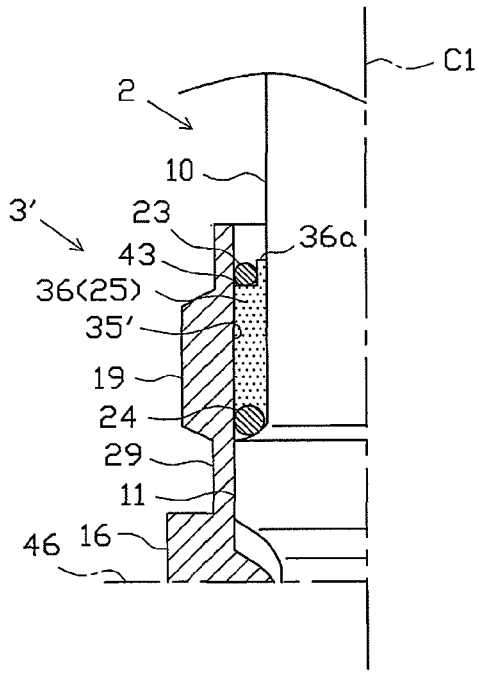
FIG. 6 Explanatory view showing a step of placing a wire packing.
Figure 7:
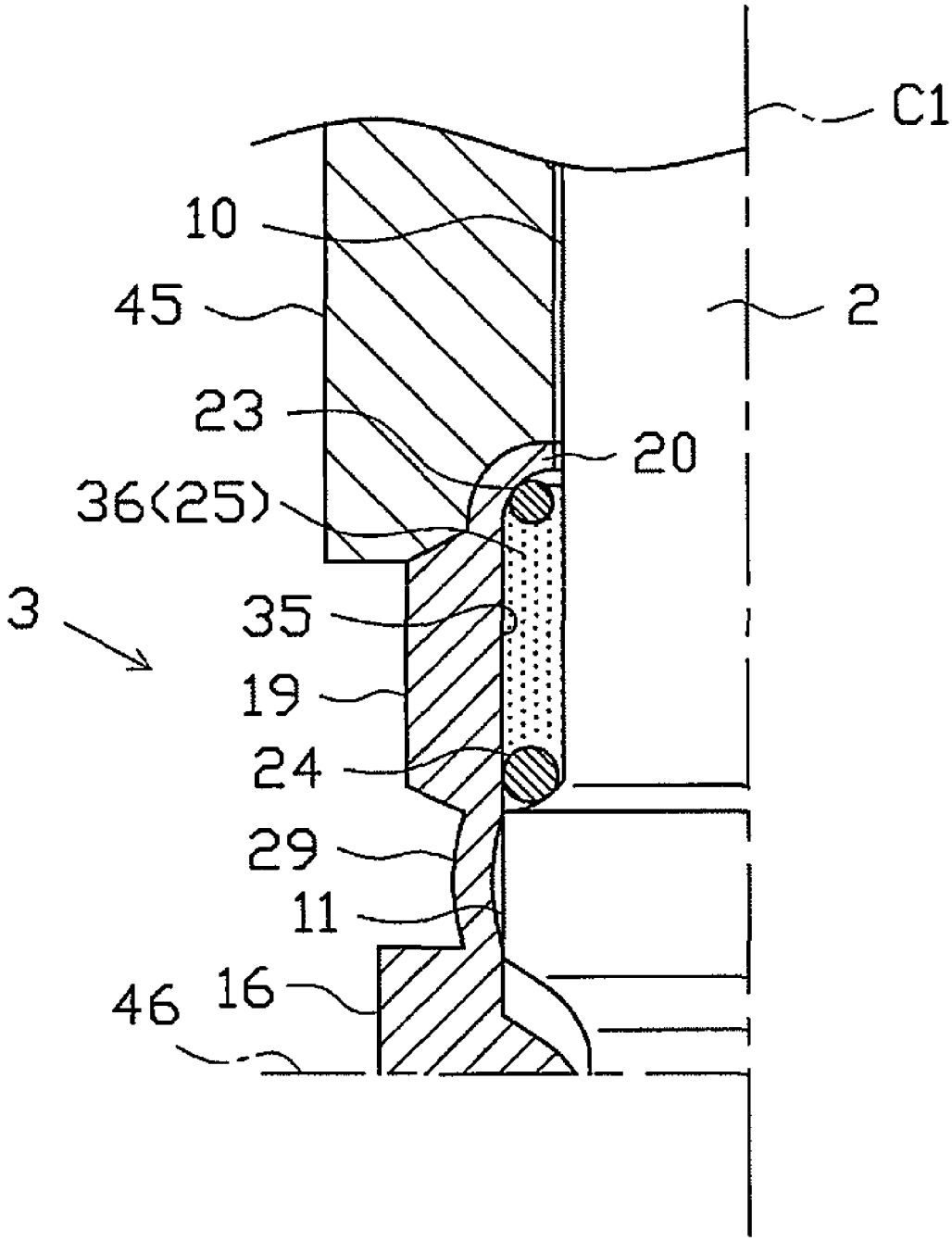
FIG. 7 Explanatory view showing a crimping step.
Figure 8:
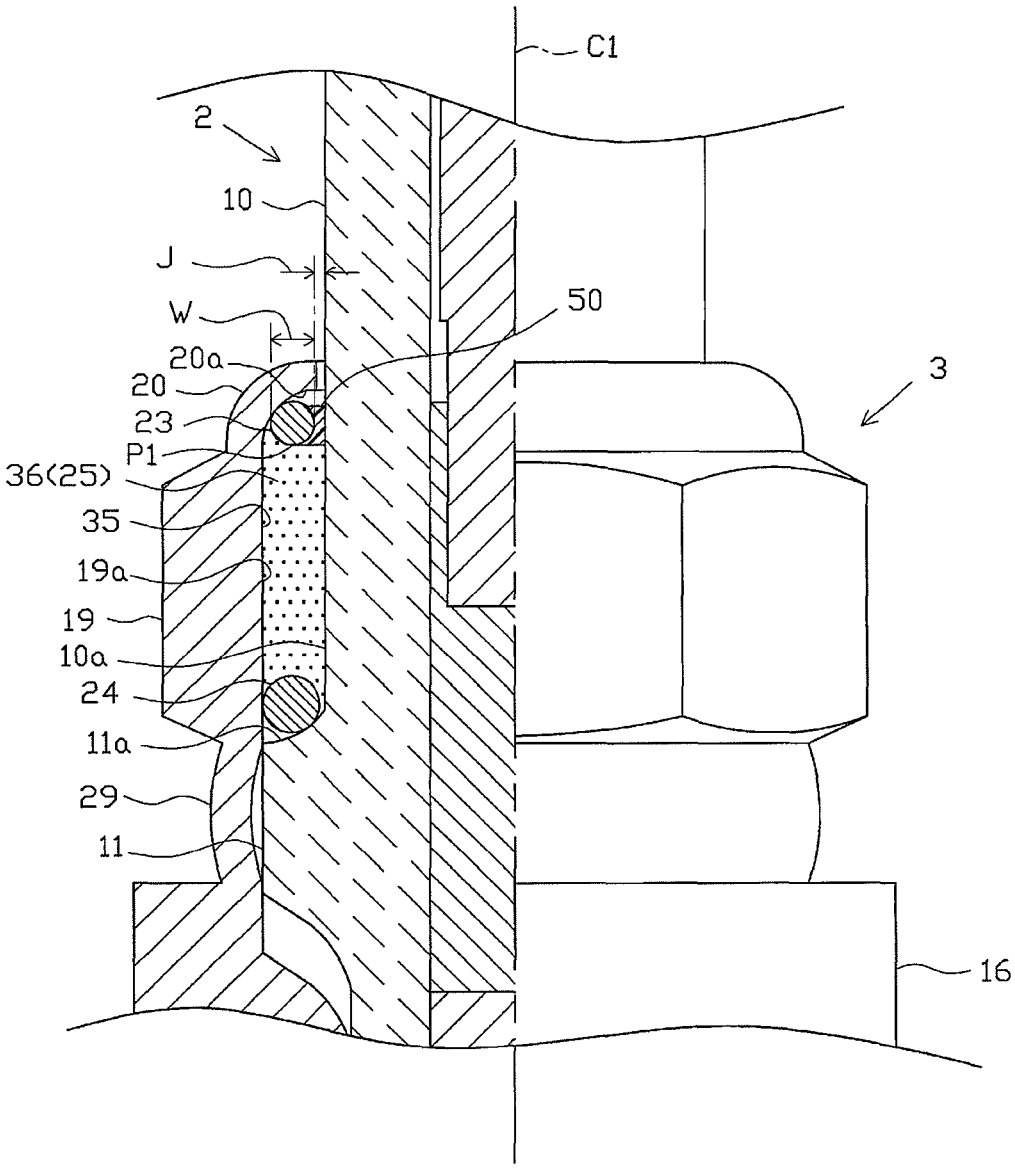
FIG. 8 Partially cutaway front view showing, on an enlarged scale, a main portion of the vicinity of a rear end portion of a metallic shell according to a second embodiment.
Figure 9:
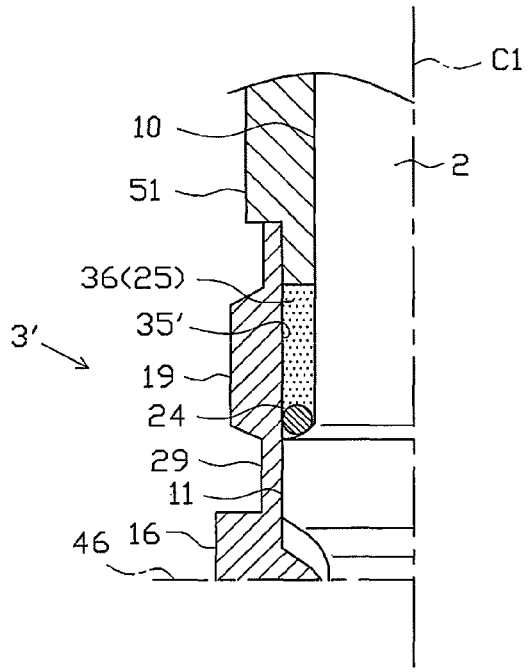
FIG. 9 Explanatory view showing a cutting step in the second embodiment.
Figure 10:
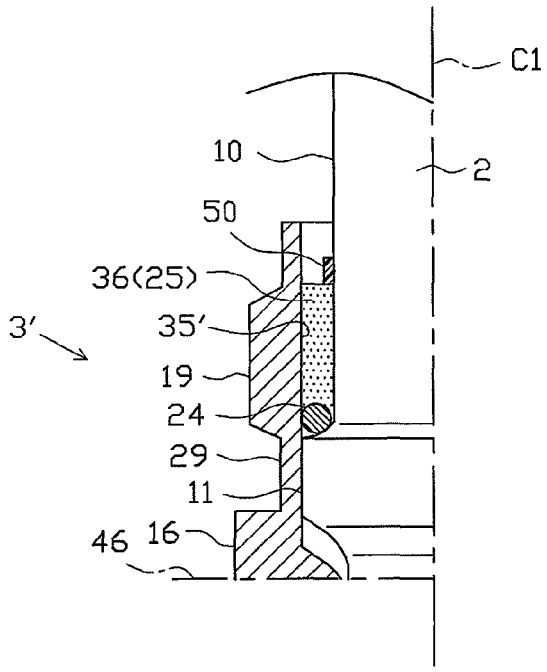
FIG. 10 Explanatory view showing a step of placing a resin ring in the second embodiment.
Figure 11:
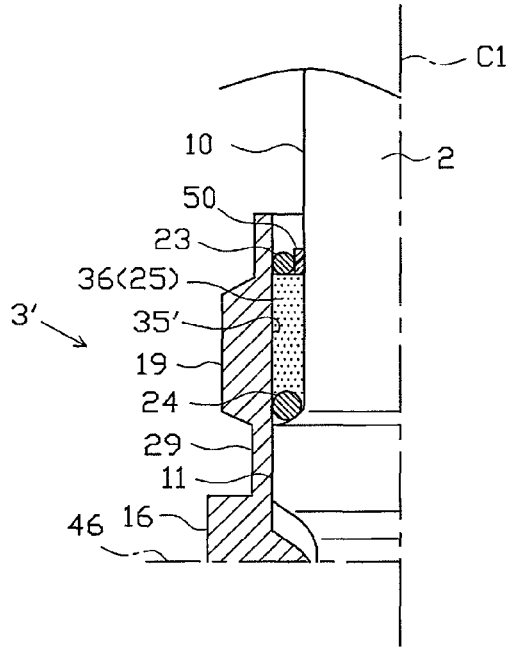
FIG. 11 Explanatory view showing a step of placing a wire packing in the second embodiment.
Figure 12:
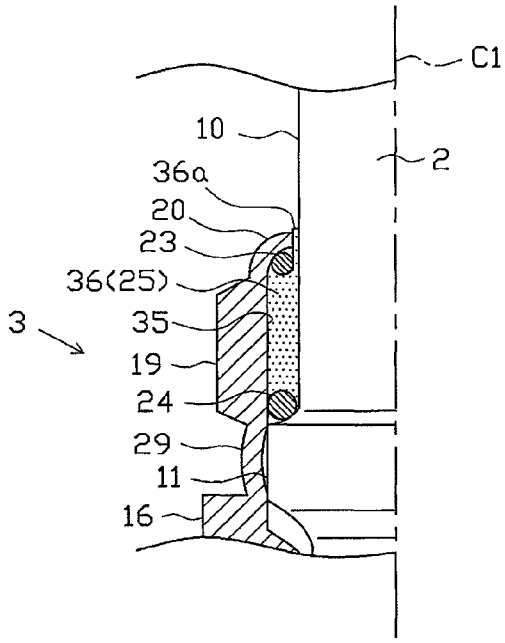
FIG. 12 Partial sectional view showing another embodiment.
Figure 13:
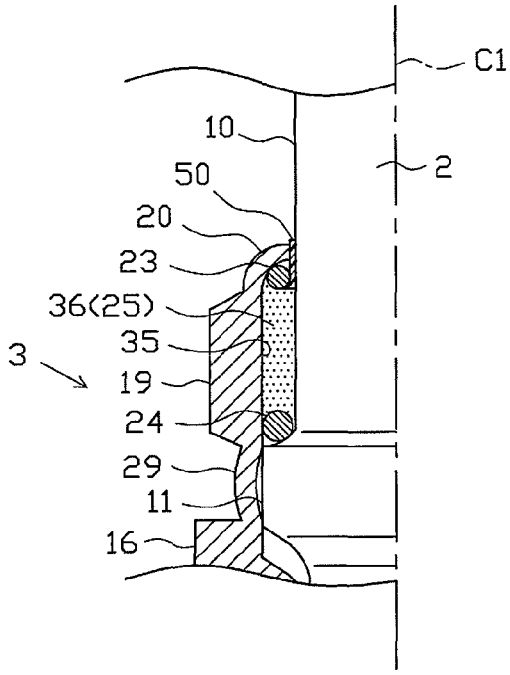
FIG. 13 Partial sectional view showing another embodiment.
Figure 14:
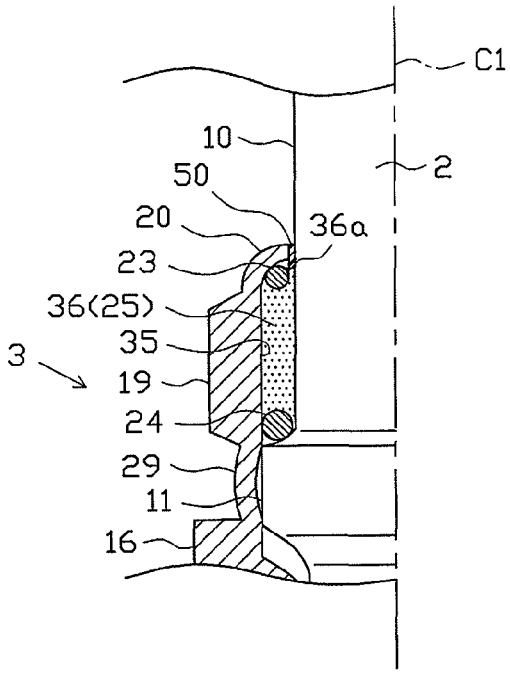
FIG. 14 Partial sectional view showing another embodiment.
Figure 15:
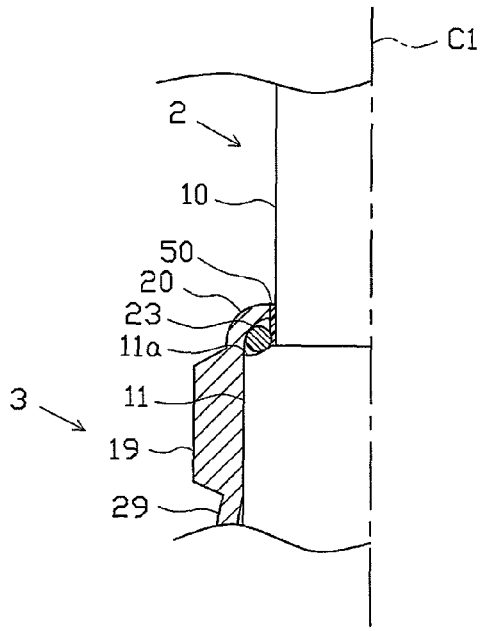
FIG. 15 Partial sectional view showing another embodiment.
Figure 16:
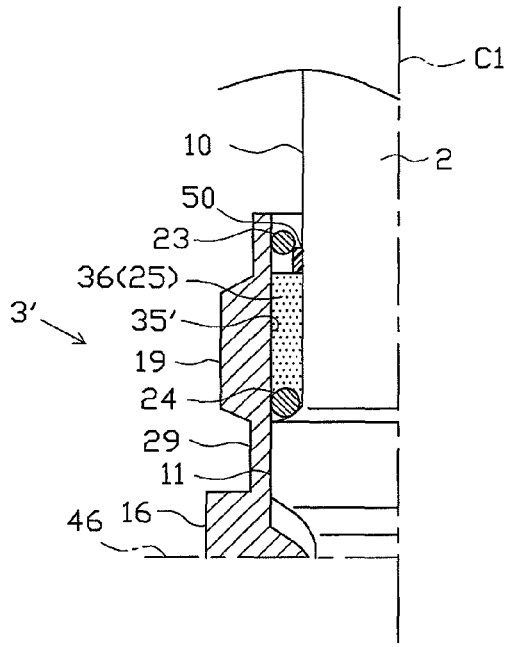
FIG. 16 Explanatory view showing a step of placing a wire packing in another embodiment.
Figure 17:
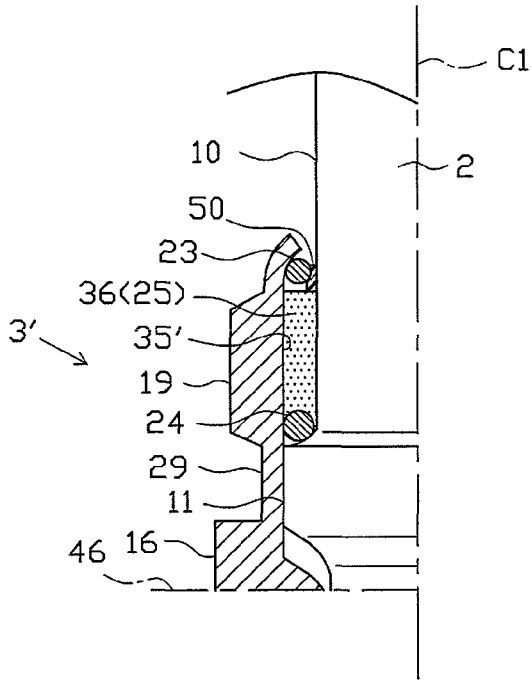
FIG. 17 Explanatory view showing a crimping step in another embodiment.
Figure 18:
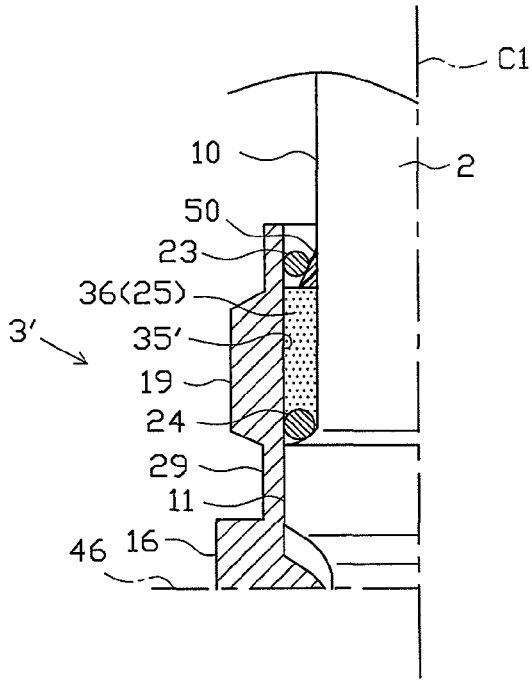
FIG. 18 Explanatory view showing a step of placing a wire packing in another embodiment.
Figure 19:
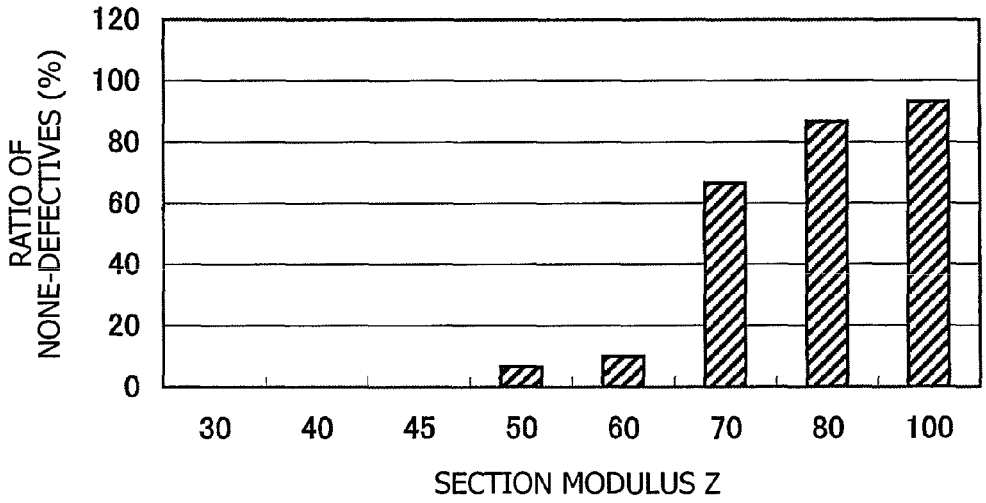
FIG. 19 Graph showing results of a test performed for conventional spark plugs having no cushioning member.
Figure 20:
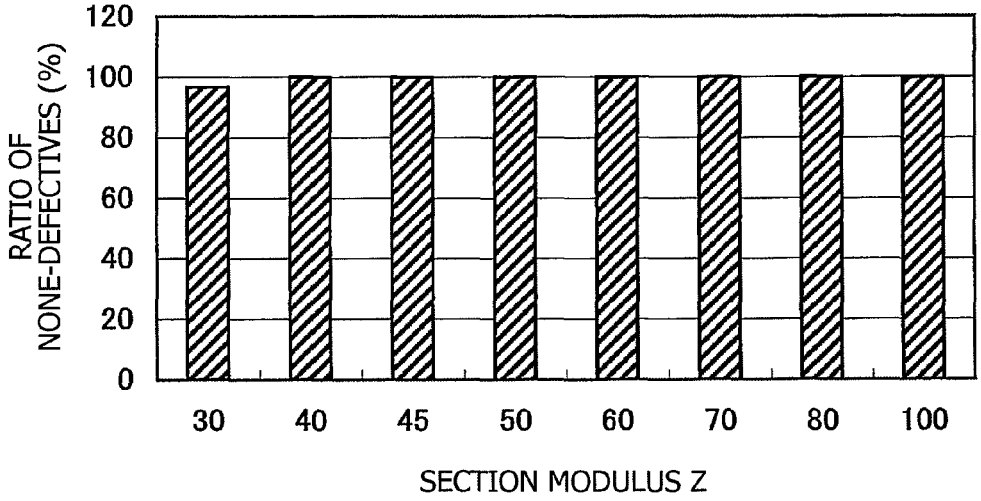
FIG. 20 Graph showing results of a test performed for spark plugs each having a cushioning member.

1 . . . spark plug; 2 . . . insulator; 3 . . . metallic shell; 10 . . . rear trunk portion; 11 . . . large diameter portion; 20 . . . crimp portion; 23, 24 . . . wire packing; 25 . . . talc powder; 35 . . . clearance portion; 36 . . . talc charged layer; radially inner portion 36*a*; C1 . . . axis.

The invention claimed is:

1. A spark plug comprising:

a center electrode;

a tubular insulator surrounding the circumference of the center electrode and having, on its outer circumferential surface, a rear trunk portion located on a rear end side thereof, and a large diameter portion located frontward of the rear trunk portion and having a diameter greater than that of the rear trunk portion;

a tubular metallic shell surrounding the circumference of the insulator and accommodating the large diameter portion of the insulator between a stepped portion formed inside the metallic shell and a crimp portion formed at a rear end portion of the metallic shell, to thereby hold the insulator;

a ground electrode provided to form a spark discharge gap in cooperation with the center electrode; and an annular packing interposed between an inner circumferential surface of the crimp portion and an outer circumferential surface of the insulator, the spark plug being characterized in that a cushioning member is interposed between the insulator and at least the crimp portion or the packing, whichever is closer to the insulator.

2. A spark plug according to claim 1, wherein the cushioning member is formed from talc powder.

3. A spark plug according to claim 2, wherein the talc powder is charged in a clearance portion surrounded by the inner circumferential surface of the crimp portion, a rear-end-side inner circumferential surface of the metallic shell continuous with the inner circumferential surface of the crimp portion, a rearward facing end surface of the large diameter portion of the insulator, and an outer circumferential surface of the rear trunk portion continuous with the rearward facing end surface; and a radially inner portion of a rear end portion, with respect to the direction of an axis, of a layer formed of the charged talc powder projects rearward, with respect to the direction of the axis, in relation to a radially outer portion of the rear end portion, and the packing is disposed on the radially outer portion.

4. A spark plug according to claim 1, wherein the cushioning member is formed from a resin material.

5. A spark plug according to claim 4, wherein, as viewed in a cross section taken along the axis, the entirety of the cushioning member is located radially inward of a frontmost portion of the packing with respect to the direction of the axis.

6. A spark plug according to claim 4, wherein, as viewed in a cross section taken along the axis, the entirety of the cushioning member is located rearward of a frontmost portion of the packing with respect to the direction of the axis.

7. A spark plug according to claim 4, wherein a relative thermal index of the resin material determined in accordance with the UL-746B standard is 100° C. or higher.

8. A spark plug according to claim 1, wherein the section modulus Z of the insulator at a position facing the crimp portion is 60 or less.

9. A spark plug according to claim 1, wherein the rear trunk portion of the insulator facing the crimp portion has a diameter of 8 mm or less.

10. A spark plug according to claim 1, wherein a threaded portion which is formed on the metallic shell for attachment to an internal combustion engine has a nominal diameter of M10 or less.

11. A method for manufacturing a spark plug comprising:

a center electrode;

a tubular insulator surrounding the circumference of the center electrode and having, on its outer circumferential surface, a rear trunk portion located on a rear end side thereof, and a large diameter portion located frontward of the rear trunk portion and having a diameter greater than that of the rear trunk portion;

a tubular metallic shell surrounding the circumference of the insulator and accommodating the large diameter portion of the insulator between a stepped portion formed inside the metallic shell and a crimp portion formed at a rear end portion of the metallic shell, to thereby hold the insulator; and a ground electrode provided to form a spark discharge gap in cooperation with the center electrode, wherein talc powder is charged in a clearance portion surrounded by an inner circumferential surface of the crimp portion, a rear-end-side inner circumferential surface of the metallic shell continuous with the inner circumferential surface of the crimp portion, a rearward facing end surface of the large diameter portion of the insulator, and an outer circumferential surface of the rear trunk portion continuous with the rearward facing end surface; and an annular packing is interposed between the inner circumferential surface of the crimp portion and the outer circumferential surface of the rear trunk portion of the insulator, the method being characterized by comprising:

a disposing step of inserting the insulator into the metallic shell from the rear end side thereof with respect to the direction of an axis so as to dispose the insulator in a state in which the insulator is engaged with an inner circumferential portion of the metallic shell;

a charging step of charging the talc powder into the clearance portion;

a compression step of compressing a layer of the charged talc powder in the direction of the axis;

a placement step of placing the packing on a rear end portion of the layer of the charged talc powder with respect to the direction of the axis; and a crimping step of crimping a circumferential edge of the rear end portion of the metallic shell to thereby form the crimp portion, the method further comprising a placement portion forming step of forming, at least before the placement step, a placement portion, on which the packing is to be placed, on a radially outer portion of a rear end portion, with respect to the direction of the axis, of the layer of the charged talc powder.

* * * * *